US006738488B1

(12) United States Patent
Baker

(10) Patent No.: US 6,738,488 B1
(45) **Date of Patent: *May 18, 2004**

(54) PROTECTION AND SOLVENT WASHING OF IN-CANAL HEARING AIDS

(76) Inventor: Lawrence K. Baker, 119 Cyprus St., Gate City, VA (US) 24251

( * ) Notice: Subject to any disclaimer, the term of this patent is extended or adjusted under 35 U.S.C. 154(b) by 0 days.

This patent is subject to a terminal disclaimer.

(21) Appl. No.: 10/119,160

(22) Filed: Apr. 9, 2002

Related U.S. Application Data

(63) Continuation-in-part of application No. 09/864,416, filed on May 25, 2001, now Pat. No. 6,449,373.

(51) Int. Cl.[7] ..... H04R 25/00
(52) U.S. Cl. ..... 381/325; 381/322
(58) Field of Search ..... 381/325, 322, 381/328, 380, 324, 312, FOR 127, FOR 133, FOR 135; 181/129, 135

(56) References Cited

U.S. PATENT DOCUMENTS 3,842,829 A * 10/1974 Ellis ..... 128/868
4,937,876 A * 6/1990 Biermans ..... 381/324
4,972,488 A * 11/1990 Weiss et al. ..... 381/325
4,987,597 A * 1/1991 Haertl ..... 381/325
5,166,659 A * 11/1992 Navarro ..... 381/325
5,327,500 A * 7/1994 Campbell ..... 381/325
6,000,492 A * 12/1999 Puthuff et al. ..... 181/135
6,105,713 A * 8/2000 Brimhall et al. ..... 181/135
6,449,373 B2 * 9/2002 Baker ..... 381/325

* cited by examiner

*Primary Examiner*—Curtis Kuntz
*Assistant Examiner*—P. Dabney
(74) *Attorney, Agent, or Firm*—Michael Y. Epstein

(57) ABSTRACT

An otherwise conventional in-canal hearing aid, including a receiver providing a sound output port typically facing directly towards the ear drum of a user, is provided with a hood disposed between the sound port and the ear drum completely shielding the sound port from foreign substances moving towards the hearing aid from all directions except upwardly from the bottom floor of the user's ear canal. The hood can comprise solid vertical walls completely surrounding the sound port and forming a downwardly extending sound conduit terminating in a downwardly facing sound exit, or the vertical walls can comprise a mesh preferably also forming a downwardly facing sound conduit and sound exit. The hoods provide gravity assisted paths, particularly for mobile fluid components of the foreign substances, downwardly past and away from the receiver sound port. The hoods can be extensions of the hearing aid receiver at the front end of the receiver. The combination of shielding the sound port from entry of foreign substances and the presence of paths diverting fluids past the sound port greatly facilitates cleaning of the hearing aid, particularly by use of previously generally unavailable solvent washing.

9 Claims, 4 Drawing Sheets

PROTECTION AND SOLVENT WASHING OF IN-CANAL HEARING AIDS

This application is a continuation in part of application Ser. No. 09/864,416, filed May. 25, 2001 now U.S. Pat. No. 6,449,373.

BACKGROUND OF THE INVENTION

This invention relates to hearing aids, and particularly to in-canal hearing aids including means for minimizing entry into the hearing aids of wax-fluid-like substances present within the ear canal; such means also facilitating solvent washing away any such substances adhering to the hearing aids.

A major problem in the use of small hearing aids for full insertion within the ear canal of a user is the clogging of and even permanent damage to the hearing aid caused by penetration of foreign substances into the hearing aid (by "foreign substances" being meant substances foreign to the hearing aid itself). Primarily, although not limited thereto, such foreign substances are wax-like ear secretions and various fluids—both oil-like secretions and water entering the ear during washing and the like.

The prior art shows many examples of means for protecting hearing aids from such substances. One typical arrangement is shown in U.S. Pat. No. 4,984,277 to Bisgaard, et al. Therein is shown a typical in-canal hearing aid terminating in a sound port pointing, during use of the hearing aid, directly towards the user's ear drum. For preventing entry of foreign substances into the sound port, a small cap-like, impervious shield is mounted on the hearing aid directly in front of the sound port but spaced therefrom by mounting legs. Sound exiting from the sound port passes outwardly from the hearing aid through the spaces between the shield mounting legs and, while the sound is thus not directly aimed at the ear drum, the sound is guided by the walls of the ear canal to the ear drum.

As described in the patent, a primary function of the cap-like shield is to prevent foreign substances within the ear canal from being forced directly into the hearing aid during insertion of the hearing aid into the ear canal. In effect, the cap-like shield functions as a plow for pushing aside foreign substances in the path of advance of the hearing aid.

In a number of other patents, such as U.S. Pat. Nos. 3,408,461, 4,532,649, 4,706,778 and 4,972,488, apertured plates or screens are placed in close proximity, and often inside, the hearing aid sound port for trapping and collecting wax which would otherwise migrate into the sound port. A problem in all these patents (including the aforecited Bisgaard et al patent), is that the various openings through the plates or screens (or around the Bisgaard et al cap) are pervious to fluids within the ear canal which can pass through the openings or around the cap directly into the sound port. While collected wax is likely to merely clog the sound exit, fluids entering into the hearing aid receiver are likely to permanently damage the receiver. Also, because of the possibility of entry of fluids into the receiver, the use of wax-dissolving solvents for washing away accumulated wax is generally precluded. Thus, removal of accumulated wax can be quite difficult.

While many other patents show various schemes for collecting or trapping foreign substances as a means for protecting the hearing aids, experience has shown that such collection mechanisms are generally unsatisfactory and, indeed, many presently used hearing aids effectively ignore the problem and leave to the user the need for frequent cleaning or replacement of the hearing aid. The structures disclosed in my co-pending, parent application greatly improve this situation. The structures disclosed herein provide additional solutions to the foreign substance problem.

SUMMARY OF THE INVENTION

An in-canal hearing aid includes a receiver having a sound port facing, when in use, directly towards the ear drum. Disposed forwardly of the sound port is a foreign substance shield which provides gravity assisted paths for fluids downwardly past and spaced from the sound port and to the floor of the ear canal below.

In first embodiments, the shields, similar to those disclosed in my copending parent application, are mounted on or comprise extensions of the hearing aid receiver. For simplicity of mounting, the shields can be disposed at the ends of cylindrical boots telescoped onto the receivers.

DESCRIPTION OF THE DRAWING

The drawings are essentially schematic and not to scale.

DESCRIPTION OF THE PREFERRED EMBODIMENTS OF THE INVENTION

Figure 1:
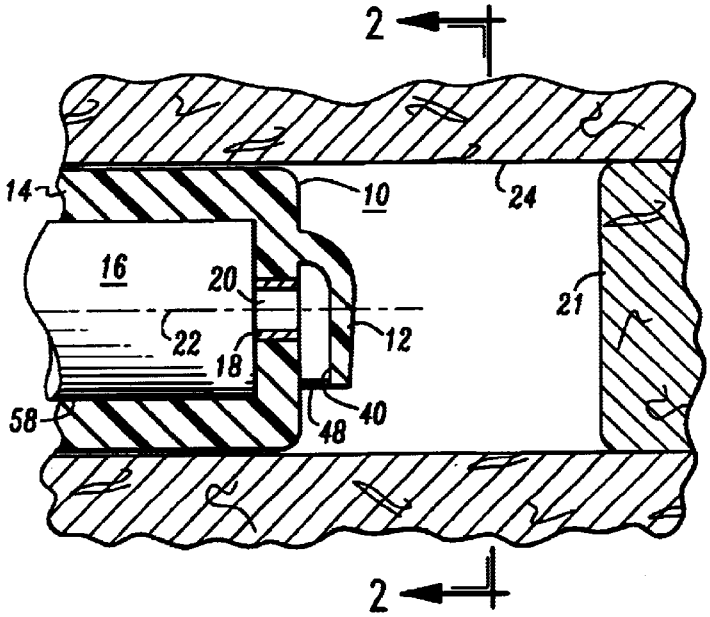
FIG. 1 is a side sectional view of the front end of a hearing aid disposed within the ear canal of a user of the hearing aid.
Figure 2:
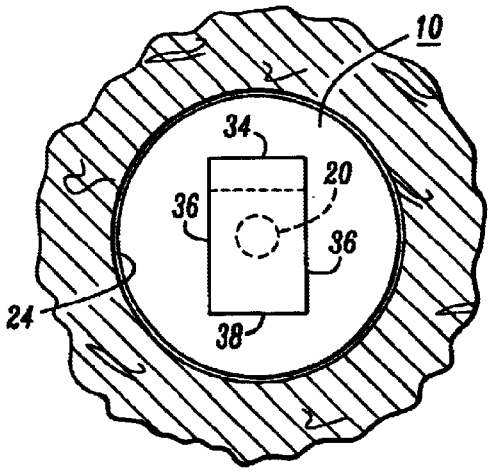
FIG. 2 is a view of the front end of the hearing aid shown in FIG. 1 looking in the direction of arrows 2—2 in FIG. 1.

Shown in FIGS. 1 and 2 is the front end of a hearing aid 10 disposed within the ear canal of a user. The hearing aid 10, except for the presence of a fluid diverting shield 12, can be of conventional design. Thus, the hearing aid 10 includes an envelope 14 enclosing a receiver 16 terminating in a sound tube 18 ending in a sound port 20 of the hearing aid. Typically, at least in those conventional hearing aids not including any foreign substance protection means, the sound port 20 comprises the leading end of the hearing aid and faces directly towards the ear drum 21 at the inner end of the user's ear canal. Also, and as shown in FIG. 1, the sound port 20 is disposed along the central axis 22 of the ear canal and at a small distance upwardly from the floor 24 of the ear canal.

The shield 12 is disposed directly in front of the sound port 20 but spaced therefrom to allow exiting of the sound from the hearing aid. In the embodiment illustrated in FIGS. 1 and 2, the shield 12 comprises a three-sided, impervious hood completely overlapping the sound port 20 and extending from a line 34 directly above the sound port, along both sides 36 of the sound port, and to a line 38 below the sound port. Except for the upper curved portion of the shield 12, all three sides of the shield are substantially vertical. At the bottom 38 of the hood shield 12 an exit 40 for sound is provided pointing directly downwardly towards the floor 24 of the ear canal. (FIG. 1 also shows a mesh 48 covering the hood exit 40. This is further discussed hereinafter.) The top 34 and side 36 edges of the hood 12 (also, see FIG. 3) are sealed to the hearing aid envelope 14. The sound exiting the sound port 20 passes downwardly through the hood 12 and towards the floor 24 of the ear canal and is thence directed to the ear drum.

The area of the path for sound through and outwardly of the hood 12 is selected, in accordance with known hearing aid design rules, not to degrade the quality of the sound being transmitted. While varying among different hearing aids, a typical sound port 20, at the end of a sound tube 18 mounted on a typical hearing aid receiver 16, has a cross-sectional area of around 0.00096 $in^2$ and a diameter of around 0.035 in. A suitable cross-sectional area for the sound through the hood 12 is also around 0.00096 $in^2$ but can, in accordance with known hearing aid design rules, be smaller. In general, the cross-section of the hood 12 can correspond to that of the receiver sound port. The path for sound downwardly through the hood can have a circular or rectilinear cross-section.

For proper, unimpeded flow of the sound outwardly (via the hood 12) of the hearing aid 10 to the user's ear drum, the hood exit 40 is preferably spaced at least slightly above the ear canal floor 24. Such spacing also avoids contact of the hood with foreign substances on the canal floor.

Conveniently, the hood 12 is an integral portion of the hearing aid envelope 14 and the hood is fabricated, typically by a known molding process, simultaneously with the formation of the envelope.

Figure 3:
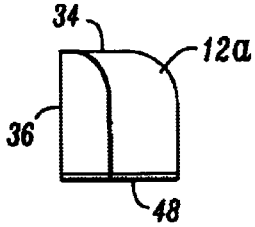
FIG. 3 is a perspective view of a hood manufactured as a separate part for attachment as by gluing, to the front end of hearing aids.

Alternatively, a hood 12*a* can be fabricated, as shown in FIG. 3, as a separate three-sided part, and adhered to the front end of the hearing aid directly in front of the sound port 20. By running a small bead of a suitable glue, e.g., an acetone based glue for a typical hearing aid acrylic envelope 14, the hood 12*a* is readily and securely attached on the front end of the hearing aid in front of the forwardly facing sound port 20.

Also, during the life of the hearing aid, the hood can be readily removed and replaced with only a slight disruption of the use of the hearing aid should the hood become excessively clogged with wax or the like. Being able to make such changes in the field, without having to return the hearing aid to the manufacturer, adds greatly to the utility of the hearing aid to the user.

The function of the hoods (e.g., the illustrated hoods 12 and 12*a*) is as follows. During initial insertion of the hearing aid into the ear canal, the hoods serve as a plow for pushing aside any foreign material in the path of the advancing hearing aid. Quite commonly, globs of wax-like material and the like lie along hairs projecting inwardly of the ear canal from the canal walls. In the absence of the plow-like function provided by the hoods, the very act of insertion of a hearing aid into the ear canal can cause direct insertion of such foreign materials into the forward facing hearing aid sound port.

As previously noted, the use of cap-like shields (such as shown in the patent to Bisgaard, et al) disposed directly in front of the hearing aid sound port is known. However, such shields have a substantially continuous, circumferential opening between the cap-like shield and the front end of the hearing aid. Wax-like globs on hairs brushed aside by the leading cap-like shield press against the advancing hearing aid and can be forced, from all directions around the hearing aid, into the circumferencial opening. In the hearing aids shown herein, however, the hoods open only downwardly and, in general, only wax-like fluids on upwardly directed hairs are likely to be thrust into the hood downwardly facing opening.

A principal advantage of the herein disclosed hoods is the elimination of flow of fluids within the ear canal into the hearing aid during actual use of the hearing aid. During such use, typically during waking hours of the user, the user's elongated ear canal is disposed in generally horizontal orientation, with a small downward slope from the ear drum towards the ear lobe. In such horizontal orientation, it is meaningful to refer to the "floor" of the ear canal with respect to up and down directions and, significantly, with respect to gravitational forces. During such waking hours, the hearing aid, typically of elongated shape, is likewise disposed generally horizontally (with top, bottom and front surfaces); with the hearing aid front surface facing directly towards the users' ear drum. Typically, the sound generating receiver within the hearing aid (see, e.g., FIG. 1) comprises a slightly elongated rectangular can disposed horizontally within the hearing aid and terminating in a short, hollow sound tube extending horizontally forwardly from the receiver to the front wall of the envelope of the hearing aid where it forms the hearing aid sound port.

A long-standing problem with typical hearing aids is that wax and fluids are continuously entering the ear canal, mostly by internal secretions, and such secretions migrate into contact with the hearing aid and penetrate openings therein. Shields, such as the afore-described prior art cap-like shields disposed directly in front of the sound port, can limit entry of foreign substances into the sound port but do not provide adequate protection. Specifically, fluid-like secretions pass into the openings surrounding the cap-like shields, pass into the sound port and penetrate deeply therein. Removal is difficult and, if the fluids reach the receiver itself, permanent damage of the receiver can occur.

With the hoods so far described in place, fully blocking passage of fluids into the hoods from all directions other than directly upwardly from the floor of the ear canal, direct entry of fluids into the sound port of the receiver—or into the hearing aid itself—is greatly minimized. In effect, the protective hoods provide paths for harmless downward flow of fluids past the sound port to the canal floor. Once on the canal floor, the fluids are safely removed from the sound port.

For further protecting against forceful insertion of foreign substances into the hood exit opening 40, particularly during initial insertion of the hearing aid, the aforementioned sound pervious mesh 48 (FIG. 1) can be used overlapping the hood exit 40. While the mesh 48 is likely to increase the incidence of wax blockage of the hood exit by providing sites to which foreign substances can directly adhere, brushing such substances off the mesh is readily done with little danger of forcing the foreign substances inwardly of the hood during the brushing process. Indeed, another major advantage of the inventive hoods, particularly with an exit covering mesh, is that waxy substances adhering to the mesh can be quite easily washed away by a brush soaked in a solvent, e.g., denatured alcohol, without danger of the solvent reaching and entering the receiver sound port. (Preferably, the solvent is immediately removed by blotting or the application of a slight vacuum.)

Even without a bottom exit covering mesh, the herein described hoods function to prevent entry of waxy substances inwardly of the hoods and thus restrict the waxy substances to being accumulated on the external surfaces of the hoods and only minimally within the sound conduits therethrough. By properly orienting the hearing aids during solvent cleaning, e.g., in the same orientation as within the ear canal, the washing products drain along flow paths leading away from the sound ports. The ability to wash hearing aids with liquid solvents is a major advantage of the present invention.

The use of sound pervious meshes in hearing aids is known and described, for example, in certain of the aforecited U.S. patents. Simply by way of example, and not limiting the choice of useable meshes, three examples of commercially available suitable meshes 48 each comprise a woven wire (e.g., stainless steel) of a) 80×80 strands per inch, 0.0055 in. diameter wire, and having a total open area of 31% (of the mesh area); b) 400×400 mesh, 0.0011 in. diameter wire, and 36% open area; and c) 200×200 mesh, 0.0016 in. diameter wire, and 46% open area. In some instances of extremely limited space for insertion of the hearing aid into the user's ear canal, meshes of the smallest possible thickness are preferred.

As noted, a purpose of the inventive hoods is to provide a path for downward flow of fluids harmlessly past the sound port 20. Because of the relatively great downward pull provided by gravity, the flow will proceed even if a number of openings are provided through the vertical walls of the hood, for example, for the passage of sound. Thus, even if fluids penetrate such openings, the fluid paths will be along the inside surface of the hoods, and still spaced from, and out of contact with, the sound port from the receiver. Even with small sound ports through the hood walls, a downward facing, relatively large sound exit opening 40 is still generally desirable for an alternate sound path if the vertical wall openings become clogged with wax-like substances. Also, the bottom opening provides drainage of mobile substances penetrating the hood wall openings.

Figure 4:
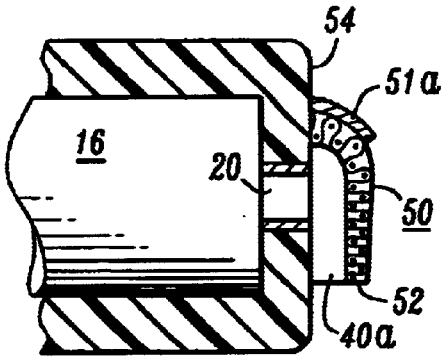
FIG. 4 shows a modification of the front end of the hearing aid shown in FIG. 1.
Figure 5:
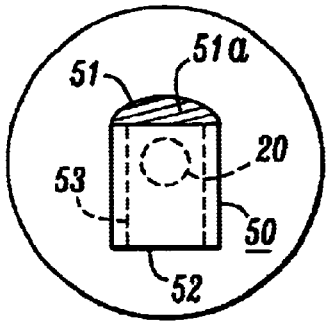
FIG. 5 is a front view of the hearing aid portion shown in FIG. 4.

Alternatively, as shown in FIGS. 4 and 5, the basically solid (even if apertured) hoods shown herein can be replaced by fully sound transparent hoods formed wholly from a mesh 50 having characteristics similar to those described for the mesh 48 shown in FIG. 1. Thus, even in the presence of the multiple openings through the mesh 50, fluids contacting the outside surface of the vertical mesh wall (even if penetrating the mesh wall and contacting the inner surface thereof) will flow downwardly along the mesh wall for by-passing the sound port 20.

For preventing fluids from flowing through the mesh 50 at its upper joint with the envelope 14 and thence downwardly along the envelope to the sound port 20, an upper portion of the mesh, including the joint 51, is coated with a layer 51 a of a fluid impervious material, e.g., a slurry formed from "super glue" (cyanoacrylate) mixed with a dental acrylitic power, the slurry being painted onto the mesh and allowed to harden. The impervious layer 51 a optionally covers around an upper third of the mesh 50.

Preferably, the bottom edge 52 of the mesh 50, except where secured to the hearing aid envelope, is spaced away from the envelope wall 54 to form a downwardly facing hood exit 40*a*. The spacing of the mesh bottom edge 52 from the envelope wall is important because, unlike the fluid impervious hood 12 shown in FIGS. 1 and 2, fluids can penetrate the hood mesh and, as noted, flow downwardly along the inside surface of the hood mesh. By avoiding a junction of most of the mesh lower edge with the envelope wall, contact of the downwardly flowing fluids with the envelope wall is minimized. This avoids accumulation of fluids at the envelope walls and possible migration of the fluids into the sound port 20. Also the open space 40*a* at the bottom of the hood avoids providing a site for accumulation of, and clogging by, substances on the canal floor.

Such accumulation of fluids at edges of screens used in the prior art and attendant flow of the fluids into the hearing aid openings covered by the screens are serious problems of the prior art use of screens. Conversely, by spacing the bottom (as well as other edges of) the inventive mesh away from the sound port, as shown in FIGS. 4 and 5 herein, the mesh contacting fluid flows past and spaced from the sound port 20 and not into it.

It is further noted that a rather large variation exists in the size, shape and secretion characteristics of the ear canals of different persons. In situations where little fluid is normally present, and particularly in a relatively large ear canal, the bottom edge 52 of the mesh 50 is optionally secured to the hearing aid wall so that the mesh completely surrounds the sound port 20. An advantage of such complete peripheral sealing of the mesh to the hearing aid wall is greater mechanical strength. Still, as previously indicated, the entire peripheral edge of the mesh is preferably spaced (e.g., by around 0.010–0.015 in.) from the edges of the sound port, for preventing entry of fluids into the sound port.

Alternatively, the mesh bottom edge can include gaps in the edge contacting the hearing aid wall for better drainage of fluids downwardly from the mesh.

In exceptionally small hearing aids, where the mesh peripheral edge is unavoidably close to the sound port, the upper impervious layer 51*a* (FIG. 4) can be extended along the sides of the mesh 50, as indicated by dashed lines 53 in FIG. 5.

Figure 6:
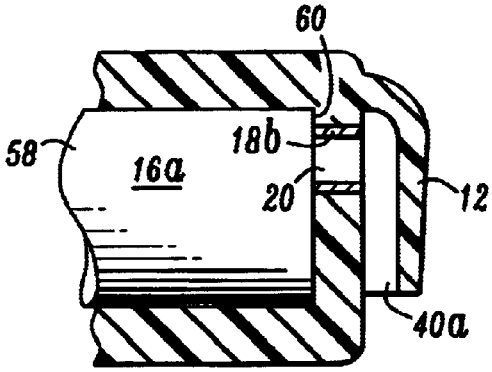
FIGS. 6 and 7 are views similar to FIG. 1 but showing two further modifications of the hearing aid shown in FIG. 1.

Typical receivers 16, such as shown in FIG. 1, comprise a slightly elongated can 58 terminating in an axially extending sound tube 18. Such axial alignment of the sound tube, in typical hearing aids, results in a central disposition of the hearing aid sound port facing directly towards the ear drum. An alternative arrangement of a hearing aid receiver 16*a*, however, is as shown in FIG. 6. In the receiver 16*a*, the sound tube 18*b* is disposed at the upper end 60 of the receiver can 58 thus further distancing the receiver port from fluids possibly entering the hearing aid. The relatively small increase (e.g., around 0.030–0.040 in.) of the distance of the tube 18*b* from the hearing aid output exit 40*a* can be the difference between the requirement of a simple cleaning of the hearing aid versus discarding a permanently damaged hearing aid.

Figure 7:
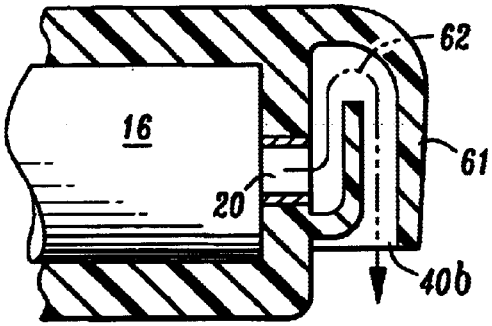

A further increase of the path length for foreign substances to the receiver port 20 is provided, as shown in FIG. 7, by the use of a hood 60 defining a sinuous or folded path 62 for sound through the hood. As in the other hoods, the sound exit 40*b* opens downwardly and at a position preferably below the sound port 20.

As mentioned, the hoods can be added, as a separate part, to existing hearing aids. The hoods can easily be added, as by gluing, to previously manufactured hearing aids in the possession of users. Also, and in many instances, the hoods can be readily incorporated into the design of presently manufactured hearing aids.

In addition to providing far greater protection of hearing aids from penetration of fluid-like foreign substances, major advantages of the hoods are their simplicity and adaptability to differing ear canal conditions. As described, the hoods can be easily added to existing types of hearing aids. Simplicity is provided by the basically different approach being used in comparison with priority known hearing aids. That is, based upon the generally symmetrical structures priorly used, it appears that the prior art has failed to recognize that the foreign substances to be protected against are an admixture of mobile fluids and generally immobile and adherent wax and, most significant, that the mobile fluids can separate from the immobile wax. Thus, a basic problem in many known hearing aids is that the foreign substance protection scheme involves collection of the foreign substances within traps or sumps actually within or closely adjacent to entrances into the hearing aid. The fact that the mobile fluids can thereafter separate from the collected substances appears to be ignored. Also ignored is the effect of gravity on the mobile fluids.

In comparison with the prior art, the present invention recognizes the admixture nature of the foreign substances and, to the extent that any accumulation of the foreign substances is likely to occur, the sites of such accumulation are preferably as far as possible, and most significantly, separated by an uphill path from any hearing aid entrances. Thus, to the extent that separation of the mobile fluid occurs, gravity is utilized for flowing the fluids away from the hearing aid entrances. Such gravity assisted guidance of mobile fluid components of the foreign substances away from the hearing aid entrances appears neither to be present nor to have been considered in the design of known hearing aids.

Stated slightly differently, the present invention differs from the prior art in that, rather than attempting to capture or trap the foreign substances, thus requiring complex and space consuming foreign substance collecting areas, the inventive hoods simply by-pass the foreign substances at a safe distance from the sound port and require only minimal increases in hearing aid dimensions. Additionally, to the extent that wax-fluid substances do accumulate on the hoods and within various openings therethrough, cleaning of the hoods is greatly facilitated by the uphill separation of the receiver sound port from the hood opening. Thus, vigorous brushing and, in particular, previously impractical solvent washing techniques, can be used with little danger of forcing the wax-fluids or the cleaning solvent directly into the receiver for causing permanent damage.

In all the hoods shown in FIGS. 1–7, the hoods are illustrated as being extensions of the envelope 14 enclosing the receiver 16. For further conservation of space (of vital importance in modern in-canal hearing aids of ever decreasing size), the fluid diverting hoods are extensions of the receiver itself.

Figure 8:
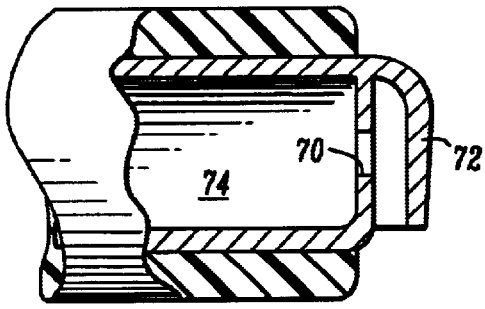
FIG. 8 is a view similar to FIG. 4 but showing a shield mounted on an end of the hearing aid receiver.

In FIG. 8, for example, a hood 72 is disposed on the outside wall of the receiver 74 in enclosing relation with the sound port 70. The hood 72 can be a separate member, such as shown in FIG. 3, and, e.g., glued to the receiver, or be an integral portion of the receiver.

Figure 9:
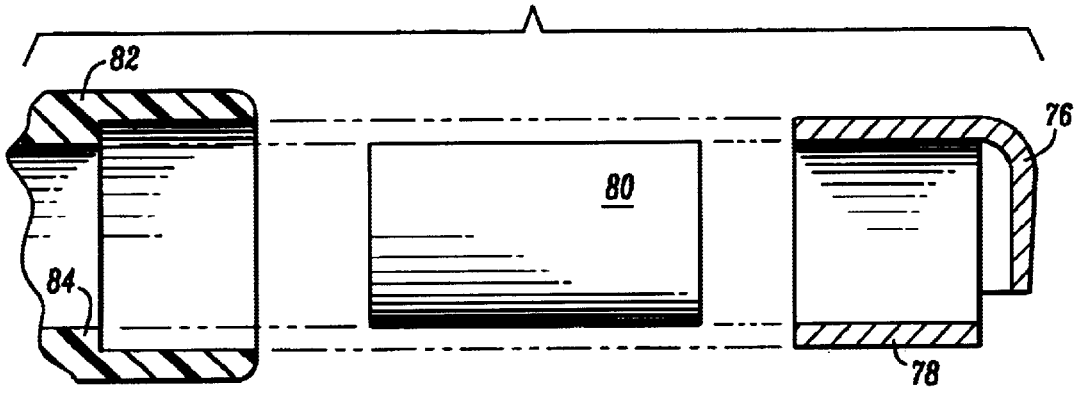
FIG. 9 is an exploded view, partially in section, showing a shield as part of a boot to be telescoped around a receiver to be inverted into a slot in a hearing aid envelope.

In FIG. 9, a hood 76 is disposed at the end of a tubular boot 78, e.g., of rubber, plastic or the like, which is telescoped onto the receiver 80 prior to the receiver being enclosed within the hearing aid envelope 82. In accordance with known technology, the receiver 80 (with the encircling boot 78 in accordance with this invention) is inserted into an elongated slot 84 at the front end of the hearing aid envelope. Electrical connections to the receiver are then made at an exposed inner end of the receiver as is presently done.

Figure 10:
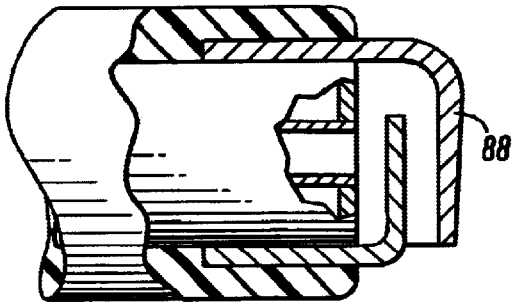
FIG. 10 is a view, partially in section, of a boot telescoped onto a receiver, the boot including a folded path shield.

FIG. 10 shows an assembled hearing aid including a boot 86 terminating in a shield 88 providing a return-bent path for sound (as in FIG. 7).

Figure 11:
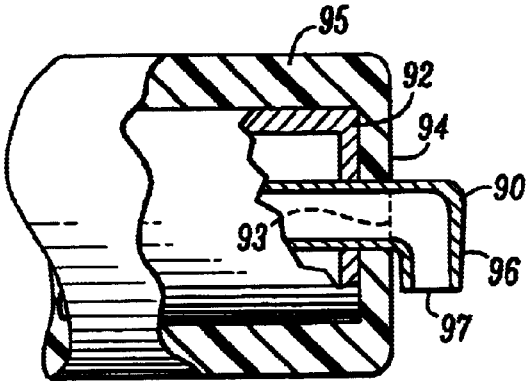
FIG. 11 is a view, partially in section, of a receiver having a downwardly bent sound tube.

In FIG. 11, the sound tube 90 from the receiver 92 extends beyond the first wall 94 of the envelope 95, and the tube 90 is provided with a downward bend so as to point directly downwardly. In terms of the use of fluid diverting shields, it is convenient to consider the sound port of the receiver as being the area 93 (indicated by a dashed line) of the sound tube 90 at the front wall 94 at the envelope 95, and the fluid diverting shield being the extending sound tube including the downwardly bent portion 96 of the sound tube terminating in a "second" sound port 97.

Fluids coming into contact with the sound tube are diverted around the sound port 93 within the sound tube 90 and flow downwardly along the shielding tube portion 96 towards the canal floor. While the fluids eventually contact the second sound port 97, the port 97 is well below the first sound port 93, whereby the likelihood of fluids flowing uphill within the sound tube and inwardly of the receiver through the first sound port 93 is very small.

Figure 12:
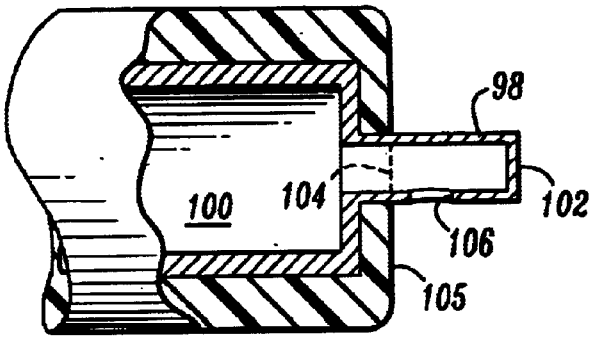
FIG. 12 is a view, partially in section, of a receiver having a sound tube modified according to one embodiment of this invention.

FIG. 12 shows an alternative arrangement from that shown in FIG. 11. Herein, the sound tube 98 extends horizontally forwardly from the receiver 100 and terminates in a closed end 102. A "first" sound port 104 is the area in the front wall 105 of the receiver shielded from entry of fluids by the closed length of the sound tube 98 extending forwardly of the port 104. A "second" sound port provided by the shield is an opening 106 through the tube wall forwardly of the first sound port 104 and facing directly downwardly.

In use, fluids contacting the sound tube 98 flow downwardly around it and thence downwardly towards the canal floor. Fluids contacting the sound port 106 can enter therein, but only in a generally uphill direction.

The arrangement shown in FIG. 12 is less preferred than the arrangement shown in FIG. 11. An advantage of the FIG. 12 embodiment is its structural simplicity.

Figure 13:
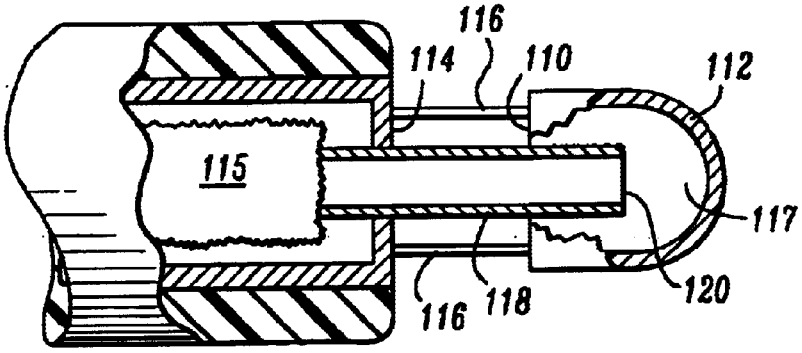
FIG. 13 is a view, partially in section, of a cap shield somewhat similar to known cap shields but wherein the receiver sound tube projects into an interior space of the shield.

FIG. 13 shows an embodiment where the rearward edge 110 of a tubular shield 112 (either solid or apertured, e.g., a mesh) is spaced apart from the front face 114 of the hearing aid receiver 115. In this embodiment, the shield 112 is hemispherical in shape and defines an enclosed or interior space 117. The shield 112 is attached by means of spaced apart legs 116 to the receiver 115. To the point thus described, the shield is somewhat similar to prior art caps hereinbefore described except that the shield 112 provides the interior, partially enclosed space 117. A major difference from the prior art is that the receiver sound tube 118 extends forwardly from the receiver front wall 114 and inwardly of the shield 112 (but not into contact with the shield inner surface). The front end 120 of the sound tube 118 is open and comprises the "first" sound port.

In use, fluids are diverted downwardly past the sound port 120 by the shield 112. Fluids can pass downwardly along the envelope front wall and past the protruding length of the sound tube to the canal floor. Flow of the fluids along the tube 118 to the open end 120 thereof is possible but unlikely. To minimize such flow, the tube 118 can be inclined slightly upwardly either deliberately in the design of the receiver or as a result of a more or less typical slightly uphill tilt of the human ear canal in the direction towards the ear drum.

The arrangement shown in FIG. 13 is less preferred than that shown in FIG. 8, but, owing to the symmetry of the shield 112, is somewhat advantageous in terms of ease of fabrication of the shield and the mounting of the shield on the hearing aid.

Although not shown, the various sound ports of the shields shown in FIGS. 8–13 are optionally covered by meshes of the type shown in FIG. 1.

What is claimed is:

1. A hearing aid for use within an elongated ear canal of a user's ear, said canal being, during typical use of the hearing aid, generally horizontally oriented and being underlaid by a canal floor extending to the user's ear drum, said hearing aid including a receiver having a first sound port disposed at a first height above said canal floor and facing towards said ear drum, and a fluid barrier disposed between said first port and said ear drum providing a continuous fluid diverting surface completely overlying said sound port from a position above said port, along both sides thereof, and to below said port, said surface providing gravity assisted paths for flow of mobile substances downwardly past and spaced from said first port to said canal floor.

2. A hearing aid according to claim 1 wherein said fluid barrier comprises a fluid diverting mesh having a peripheral edge forming a joint with a wall of said hearing aid, and a fluid impervious layer covering a portion of said mesh at an upper portion thereof for preventing wetting of said wall by fluids otherwise penetrating said upper portion.

3. A hearing aid according to claim 1 wherein said fluid barrier is an extension of said receiver.

4. A hearing aid according to claim 1 wherein said fluid barrier is mounted on an end of a tubular boot telescoped onto said receiver.

5. A hearing aid according to claim 4 wherein said fluid barrier provides a folded path for sound from said first port to a second port facing directly downwardly.

6. A hearing aid according to claim 1 wherein said fluid barrier comprises a sound tube projecting forwardly from said receiver and being in sound communication with said first sound port, said sound tube having an extension pointing downwardly and terminating in a second sound port facing directly downwardly towards said canal floor.

7. A hearing aid according to claim 1 wherein said fluid barrier comprises a sound tube projecting forwardly from said receiver wall and being in sound communication with said first port, said sound tube projecting directly forwardly towards said ear drum and having a closed leading end, and an opening through a wall of said sound tube rearwardly of said closed end and providing a second sound port facing directly downwardly towards said canal floor.

8. A hearing aid according to claim 1 wherein said receiver includes a sound tube projecting forwardly from said receiver towards said ear drum and terminating in said first port, and said fluid barrier comprises a cap-like member disposed in encompassing, spaced apart relation with said first port.

9. A hearing aid according to claim 8 wherein said cap-like member has a hollow, tubular shape having a closed first end facing directly towards said ear drum and a second end facing towards and spaced from said receiver, said sound tube extending into said tubular member through said second end.

* * * * *